United States Patent [19]

Spierings

[11] Patent Number: 4,679,848

[45] Date of Patent: Jul. 14, 1987

[54] BACK SUPPORT MECHANISM AND METHOD

[76] Inventor: Petrus A. M. Spierings, 85 E. India Row, Apt. 24C, Boston, Mass. 02110

[21] Appl. No.: 895,590

[22] Filed: Aug. 14, 1986

Related U.S. Application Data

[63] Continuation of Ser. No. 700,736, Feb. 11, 1985, abandoned.

[51] Int. Cl.[4] ..... A47C 7/46

[52] U.S. Cl. ..... 297/284; 5/417; 297/460

[58] Field of Search ..... 297/284, 452, 352, 460, 297/DIG. 2; 220/DIG. 13; 229/8; 5/432, 417, 433; 217/62; 190/2, 8

[56] References Cited

U.S. PATENT DOCUMENTS

| | | | |
|---|---|---|---|
| 2,504,190 | 4/1950 | Farrell | 297/452 X |
| 2,551,976 | 5/1951 | Smith | 5/433 |
| 2,607,400 | 8/1952 | Witz | 297/284 X |
| 3,233,885 | 2/1966 | Propst | 297/452 |
| 3,288,525 | 11/1966 | Cerf | 297/284 |
| 3,627,086 | 12/1971 | Caigan | 190/8 |
| 3,877,750 | 4/1975 | Scholpp | 297/377 X |
| 3,929,222 | 12/1975 | Smith et al. | 229/8 X |
| 4,068,889 | 1/1978 | Pierce et al. | 297/352 |
| 4,370,767 | 1/1983 | Fraser | 5/417 |
| 4,437,570 | 3/1984 | Sorenson | 229/8 X |

FOREIGN PATENT DOCUMENTS

| | | | |
|---|---|---|---|
| 228386 | 11/1958 | Australia | 297/488 |
| 2830783 | 11/1979 | Fed. Rep. of Germany | 297/284 |
| 806128 | 12/1936 | France | 190/8 |
| 26248 | 1/1913 | United Kingdom | 5/432 |

*Primary Examiner*—Kenneth J. Dorner
*Assistant Examiner*—Thomas A. Rendos
*Attorney, Agent, or Firm*—Weingarten, Schurgin, Gagnebin & Hayes

[57] ABSTRACT

A plastic back support plate, formed of a firm but bendable material is connected to two side plates by curved integral hinges along opposite edges of the support plate that engages the back of the user. When deflected, these side plates cause the back support plate to be curved to a degree depending upon the angular deflection of the two side plates. The side plates are secured in the desired position by an adjustable strap extending between the outer edges of the side plates.

To enhance portability, the back support mechanism is formed of a plurality of linear parallel segments that are connected together by linear integral hinges. These straight hinges are spaced and extend from edge to edge across the entire back support mechanism. When the side plates are undeflected, that is, lie in the plane of the support plate, the mechanism can be folded into a roll, about an axis parallel with the straight hinges, and that roll is comparable in size to a small folding umbrella.

45 Claims, 12 Drawing Figures

BACK SUPPORT MECHANISM AND METHOD

This application is a continuation of application Ser. No. 700,736, filed Feb. 11, 1985, now abandoned.

BACKGROUND OF THE INVENTION

1. Field of the Invention

This invention relates to back support mechanisms and more particularly to a foldable, portable back support mechanism that can be adjusted readily to a specific and repeatable contour.

2. Brief Description of the Prior Art

Back pains have been a continuing problem for a significant part of the population and countless devices and procedures have been developed to relieve and remedy recurrent back pains. Many people have chronic back pains and relief, if any, lies only in the realm of medical treatment, not in support mechanisms of the type described here which are intended for use by those in generally good health with occasional back pains caused by improper posture or support.

Various forms of cushions and bladders have been used, but generally do a poor job of directly controlling the spinal posture. Such cushions and bladders are relatively elastic structures that exert more or less uniform forces on the back but do not consistently force the spine into the appropriate configuration. They may, however, provide some relief for those with the patience to arrive at a satisfactory configuration through trial and error. Lack of repeatability of a particular configuration is a continuing problem.

U.S. Pat. No. 3,974,827 to Bodeen describes a back support with a semi-flexible flat backing member placed behind an inflatable bladder to direct pressure from the bladder in a forward direction against the spinal column of the user. U.S. Pat. No. 4,068,889 to Pierce et al. describes a portable backrest intended to be secured to a bench or seat that has no back support. The backrest is formed from a single piece of flexible material with a pair of foldable side panels that in use extend forward from the back structure. Means are provided to secure the backrest to the front and rear of the seat. U.S. Pat. No. 4,350,388 to Weiner describes an adjustable chair backrest having a flexible back support member secured to a rigid base member. The contour of the support member is changed by moving the location of a spacer positioned between the support and the base member. U.S. Pat. No. 4,362,334 to Ross et al. describes a folding backrest for use on a chair or other seat which provides two spaced vertically adjustable resilient pads that provide support for the back. U.S. Pat. No. 4,462,635 to Lance shows a flexible back support member whose configuration is controlled by changing the tension on a strap engaging the rear of the back support member.

It is generally recognized that standing is more comfortable for the back than sitting; few healthy people suffer from back pain when standing. The tilt of the pelvic bone and the shape naturally formed by the vertebrae have been recognized as the crucial elements of that painlesss posture. Back pains will therefore be minimized, if one can be seated in the "standing position". This has been substantially achieved by the Swedish "Balance" chair design, which relaxes the legs, but has no back support. Unfortunately, that chair is not very portable.

Although much design study has resulted in seats for theatres, airlines and the like that provide long term back comfort for a majority of individuals, many seats designed for office, home or auto use have not been so well designed from the standpoint of long term comfort.

Accordingly, there remains a need for a portable, light-weight, adjustable back support mechanism that can be folded without loss of the contour information and which addresses the spinal posture to provide immediate relief from back pain and which may in some instances provide correction of the causes of certain kinds of back pain over the longer term. Nothing in the prior art fulfills this need.

SUMMARY OF THE INVENTION

A back support mechanism includes a thin back support plate, formed of a firm but bendable material, that is connected to two side plates by curved integral hinge structures, positioned along opposite edges of the support plate that engages the back of the user. When deflected, the side plates produce and control the contour of the support plate and contribute structurally to the strength of the support plate. The side plates thus essentially act as strength and form imparting levers. As used herein, a side plate acts as a strength and form imparting lever in each of the several embodiments.

When the side plates are deflected about the integral hinges, the support plate is deformed elastically into an orthopedically correct shape for back support. The support plate will bend primarily in one direction because of the mechanical interaction produced between the plates by the curved hinges. The contour of the back support is determined by the shape of the curved hinges and by the angle of deflection of the side plates. The shape of the curved hinges is based on orthopedic studies and experiments and on geometric considerations related to the mechanism. The angular deflections of the side plates are adjusted by the user to best meet his comfort needs and are secured in that position by an adjustable strap extending between the outer edges of the side plates. The support plate provides a consistent firm orthopedically correct shape.

To enhance portability, a set of straight integral hinges may also be included in the structure to permit folding the unit into a small roll that is easily transported. These straight hinges are spaced and extend from edge to edge across the entire back support mechanism in a direction generally perpendicular to a straight line extending between the ends of either of the curved hinges. When the side plates are undeflected, that is, lie in the plane of the support plate, the mechanism can be folded into a roll about an axis parallel with the straight hinges, and that roll is comparable in size to a small folding umbrella.

DESCRIPTION OF THE PREFERRED EMBODIMENTS

Figure 1:
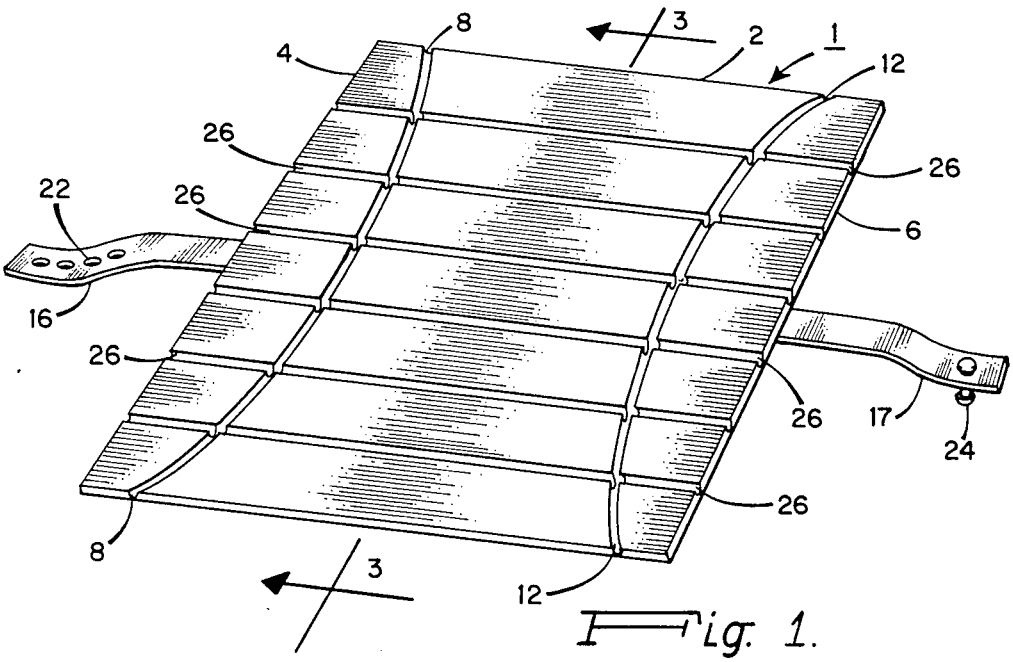
FIG. 1 is a perspective view of the rear side of a back support mechanism embodying the invention showing the arrangement of the components when the back support is in the undeflected state.

As shown in the drawings, in which similar parts are indicated by the same numerals, or the same numerals followed by a letter suffix, a back support mechanism, generally indicated at 1, is formed by a back support plate 2 and two side plates 4 and 6. The back support mechanism is illustrated as generally rectangular in outline, but the outer edges of the side plates 4 and 6 need not be straight. The entire back support mechanism is molded in one piece from firm but bendable plastic. Two of the outer edges of the back support plate 2 are generally concave with respect to each other as illustrated in FIG. 1, which is a view of the rear surfaces of the back support mechanism.

The side plate 4 is joined to the back support plate 2 by a curved integral hinge structure formed by relieving the two plates, as illustrated, along the curved hinge line 8. The hinge structure is formed by a V-shaped notch that extends most of the distance through the thickness of the back support mechanism and permits the side plate 4 to fold rearward with respect to the back support plate 2. In a similar manner, the other side plate 6 is defined from the back support member 2 by a second curved hinge line 12. The preferred material for construction of the back support mechanism is a moldable thermoplastic material such as polypropylene, more specifically oriented polypropylene. Any other material having the requisite flexibility, strength, durability etc. may be used.

Figure 4:
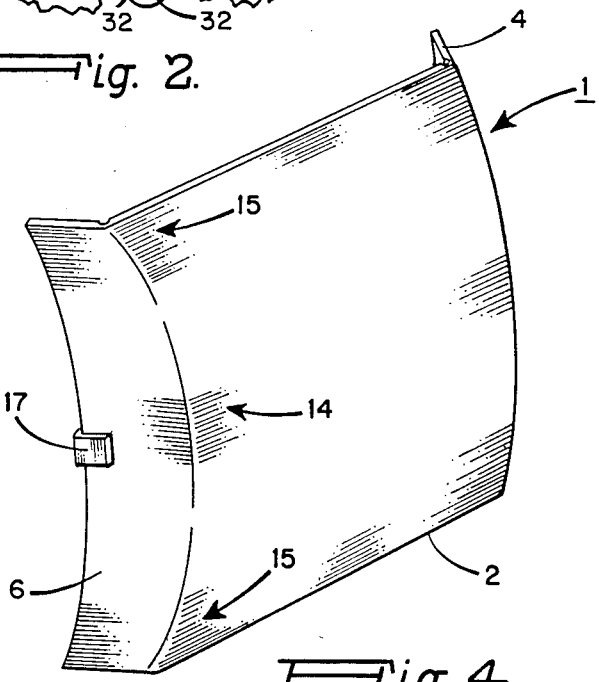
FIG. 4 is a perspective view from the front of the back support mechanism in the deflected state.

With this arrangement, when the side plates 4 and 6 are deflected angularly backwards from the plane of the back support plate 2, the mechanical interaction between the side plates 4 and 6 and the back support plate 2, because of the curved hinge structure, causes the central portion of the back support plate 2 to be forced forwardly, in the area indicated by the arrow 14 in FIG. 4, and be pulled rearwardly in the end areas as indicated by the arrows 15 in FIG. 4. Because of the symmetry of the two curved hinge lines 8 and 12, the back support plate 2 will be contoured in one direction. The contour of the back support plate 2 depends upon the shape of the particular curve of the two hinge lines 8 and 12 and also upon the deflection of the side plates; the greater the angular deflection of the side plates 4 and 6, the more curvature is produced in the back support plate 2. The shape of the curved hinge lines has been derived from experimental and theoretical orthopedic shape requirements to best provide spinal posture conducive to long term comfort. In the lumbar region of support, each curve may approximate the arc of a circle having a radius of about ten inches. The upper part of the curves may have larger radii shaped to join smoothly with the curve in the lumbar region. However, the exact shape of the hinge curves is not so critical as it would otherwise be because of the contour variation produced by different angular deflections of the side plates. This feature permits in use adjustment of the back support mechanism to best meet the particular requirements of the user.

Locking means are provided to secure the side plates 4 and 6 in any desired position of deflection. In this example, two straps 16 and 17 are secured respectively to the outer edges of the side plates 4 and 6. The straps may be of plastic material having surface hook and eye arrangements that cause the straps to adhere on contact, such as the material widely sold under the trademark "VELCRO", or other means of attachment may be provided. For example, the strap 16 may be provided with a series of spaced eyelets 22 to receive a locking member 24 secured to the strap 17. In use, the straps are overlapped at the desired angular deflection of the side plates, and secured in that position by pressing the "VELCRO" hook and loop-fastening surfaces together or putting the locking member 24 through the appropriate eyelet 22 and securing it in that position. With the latter arrangement, the back support mechanism can be returned precisely to the same contour by the simple expedient of using the same eyelet. In use, the back support mechanism, after adjusting for the desired contour, is placed against the back of a chair, auto seat, or other support device.

Figure 5:
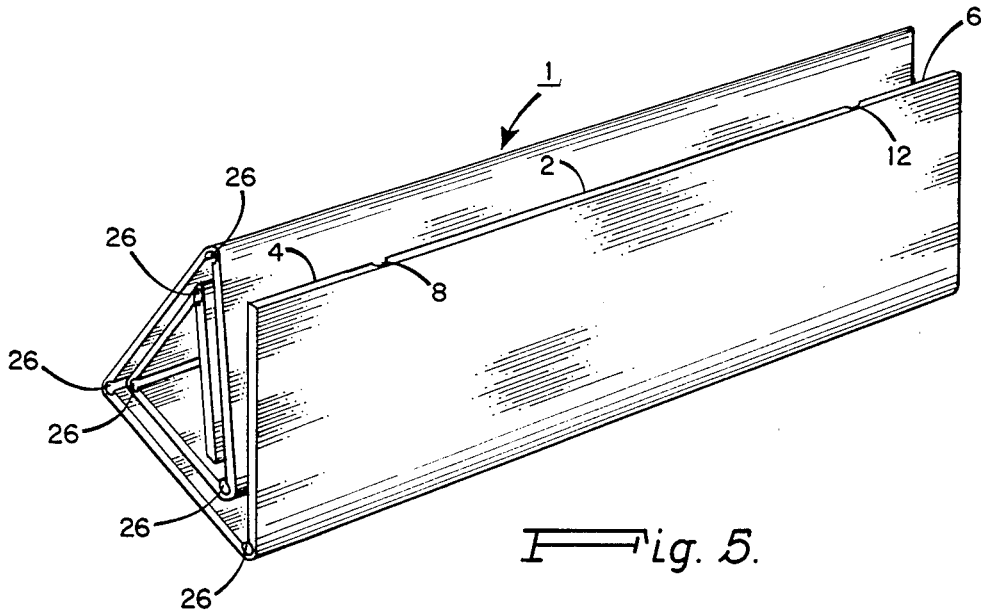
FIG. 5 is a perspective view of the back support mechanism folded and rolled for carrying.

To provide for convenient portability or storage, a series of spaced, parallel, linear integral hinges 26 extend across the back support mechanism 1, intersecting the curved hinge lines 8 and 12. These hinges are formed in the same manner as the curved hinges, that is, by V-shaped notches that permit the mechanism to be folded along these straight hinge lines. To fold the unit, the straps 16 and 17 are released and the unit laid flat as shown in FIG. 1. It is then rolled in a direction perpendicular to the straight lines of the hinges 26 into a compact bundle as illustrated by FIG. 5.

The construction described has many advantages both in manufacturing economies and in practical use. The entire mechanism can be molded as an integral unit of light weight. Only the straps 16 and 17, or other restraining device, need to be added to the mechanism after the molding operation.

Figure 2:
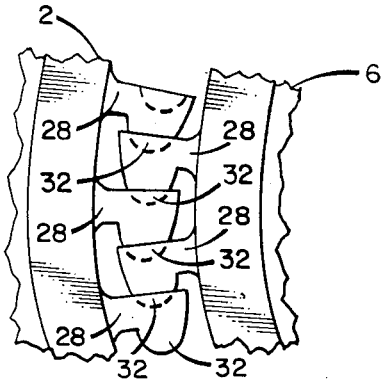
FIG. 2 is a partial enlarged rear view illustrating the use of zipper-tooth type hinge structures.
Figure 3:
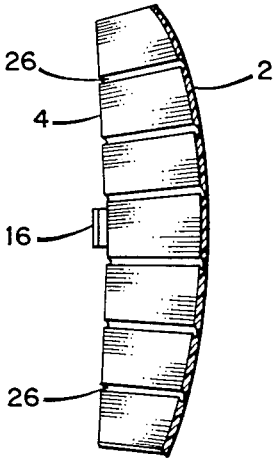
FIG. 3 is a cross-sectional view, generally along line 3—3 of FIG. 1, with the back support mechanism deflected for use.

However, any desired hinging mechanism may be used to permit the desired deflection of the side plates 4 and 6. For example, separate continuous relative-motion type hinges may be attached to the back support plate 2 and the two side plates 4 and 6. A hinge-type which is "pinless" and resembles closely a series of engaged zipper teeth, may be used for this purpose and will be referred to as a "zipper-tooth hinge". The partial enlarged rear view of FIG. 2 shows a zipper-tooth hinge 28 having a series of approximately spherical locking "pins" 32 to permit the desired hinging between the back support plate 2 and the side support plates 4 and 6. In this instance, the back support plate 2 and the side plates 4 and 6 are fabricated as individual parts and are secured together along the curved hinge lines by zipper-tooth hinges of the type illustrated at 28.

Figure 6:
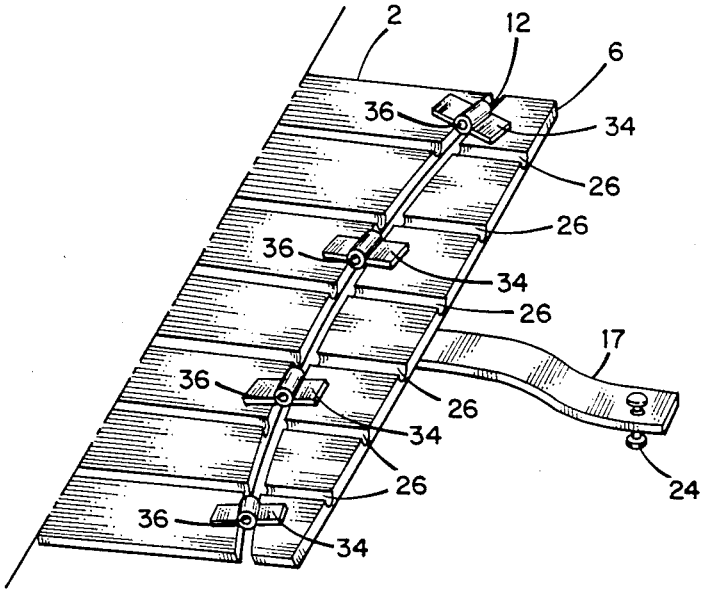
FIG. 6 is a partial perspective view of another embodiment of the invention in which the curved integral hinges have been approximated by a series of spaced linear pin-in-hole hinges.

FIG. 6 illustrates the use of separate descrete pin type hinges 34 as a substitute for the continuous hinges described in the earlier embodiments. The side plate 6, in this embodiment, is formed by a single piece of plastic having integral hinged sections, to permit folding the mechanism for storage or transport. The side plate 6 is connected to the back support plate 2 by the hinges 34, one section of each hinge being secured to the side plate 6 and the other section being secured to the back support plate 2. Each hinge has a hinge pin 36 that is positioned tangent to the imaginary curved hinge line at that point. The other side plate 4 may be formed and secured along the opposite edge to the back support plate 2 in the same manner. Thus, although the hinges 34 are in themselves linear in action, together they approximate the curved hinge lines formed by the continuous hinges.

Other hinge and side plate arrangements are possible to produce the desired contour of the back support plate 2. FIGS. 7 through 10 illustrate embodiments in which the straight integral hinges have been eliminated for simplicity, but may be incorporated if desired. Such arrangements simplify the construction to some extent, but do not provide easily for the compact folding feature for transportation or storage. In these embodiments, the side plates are formed separately from the back support plate, which may be generally rectangular or square, and are secured to the rear of the back support plate by hinges of either the continuous or discontinuous type. In each of these embodiments obvious modifications may be necessary for the straps 16 and 17. The back support plate and the side plates may be formed of the same type of firm but bendable plastic or other suitable bendable material.

Figure 7:
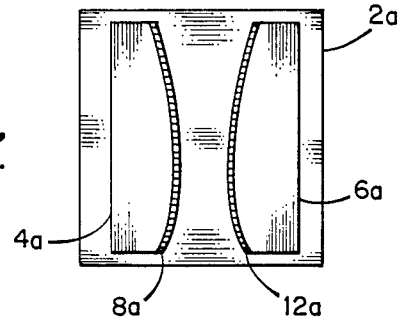
FIG. 7 is a rear view of a back support mechanism illustrating an alternate placement of the side plates and curved hinges.

As shown in FIG. 7, two side plates 4*a* and 6*a* are connected to the back support plate 2*a* by continuous hinges 8*a* and 12*a*, which lie along convex lines relative to each other. In the undeflected position, the side plates 4*a* and 6*a* lie adjacent the rear of the back support plate 2*a*. When the side plates 4*a* and 6*a* are deflected away from the back support plate 2*a*, the support plate assumes a curved contour as in the previous embodiments, the degree of contour depending upon the amount of deflection of the side plates.

Figure 8:
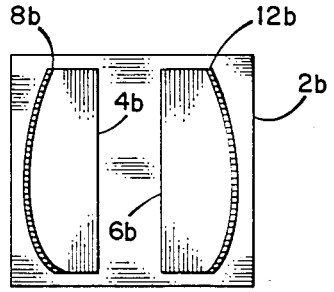
FIG. 8 is a rear view of a back support mechanism illustrating another alternate placement and orientation of the side plates and curved hinges.

FIG. 8 illustrates a configuration similar to that of FIG. 7 except the arcuate hinges 8*b* and 12*b* extend along curved lines that are concave relative to each other. The resulting contour of the back support 2*b*, upon angular deflection of the plates 4*b* and 6*b*, is the same as in the previous examples.

Figure 9:
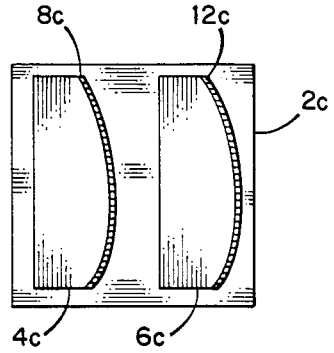
FIG. 9 is a rear view of a back support mechanism showing yet another arrangement of the side plates and curved hinges.

In the arrangement illustrated in FIG. 9, the curved hinges 8*c* and 12*c* lie along similar curved lines that are laterally displaced with respect to each other at all corresponding points. With this construction, the side plates 4*c* and 6*c* are deflected by moving in the same direction, whereas in the previous examples the side plates were deflected in opposite angular directions to produce the desired contour of the back support plate 2*c*.

Figure 10:
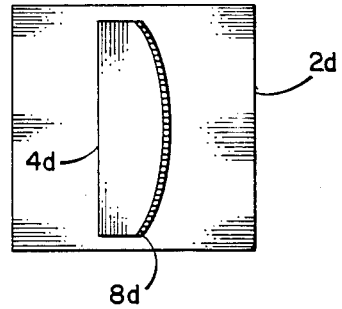
FIG. 10 is a rear view of another embodiment of the invention in which a single side plate controls the contour of the back support plate.

If desired, a single side plate 4*d*, positioned centrally of the back support plate 2*d*, and connected to the plate 2*d* along the curved hinge line 8*d*, may be substituted for the two side plates as illustrated by FIG. 10. The term "side plate" is used here for consistency of terminology and is intended to include a plate attached to the rear of the back support plate as well as one attached along an edge of the back support plate. This construction may have advantages for specialized applications, but for general use is less desirable than the previously described arrangements using two side plates.

Figure 11:
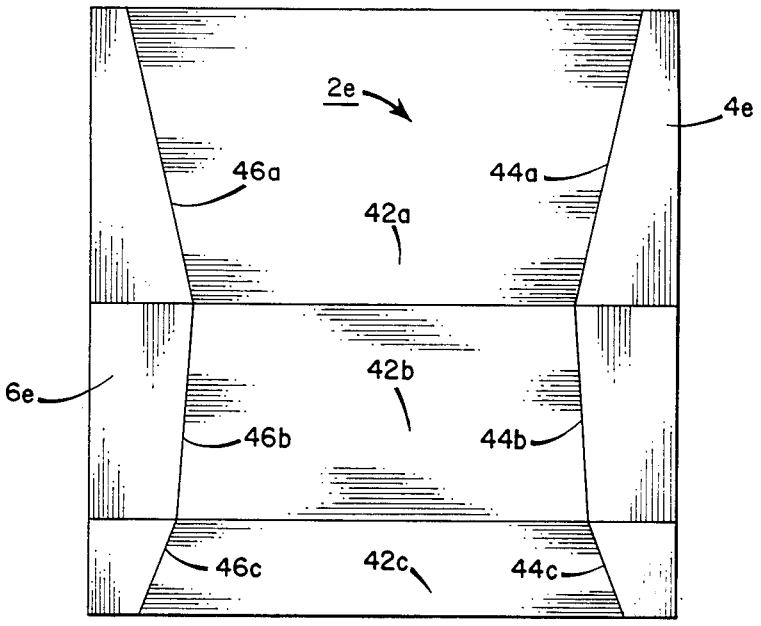
FIG. 11 is a plan view of another embodiment of the invention showing the back support mechanism in its unfolded condition.
Figure 12:
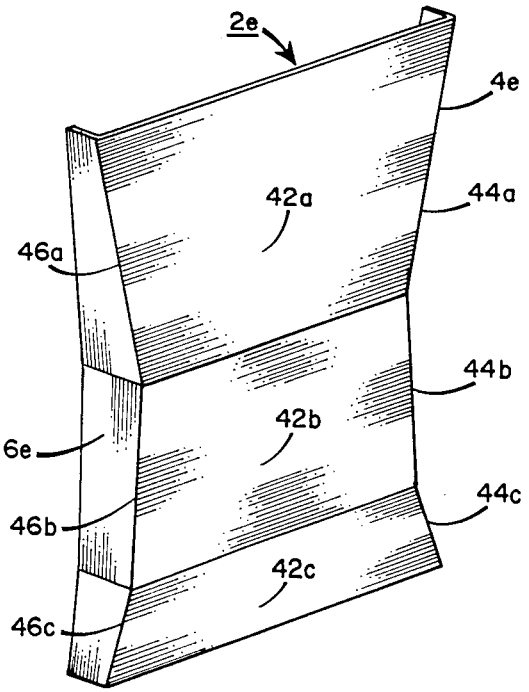
FIG. 12 is a perspective view of the front of the back support mechanism of FIG. 11 in its folded condition.

FIGS. 11 and 12 illustrate yet another embodiment in which the back support plate, generally indicated at 2*e*, is divided into three sections. Each of these sections 42*a*, 42*b* and 42*c* is joined, respectively, to the side plate 4*e* by substantially straight integral hinge sections 44*a*, 44*b* and 44*c*. Similar straight integral hinge sections 46*a*, 46*b* and 46*c* join the back support sections 42*a*, 42*b* and 42*c*, respectively, to the side plate 6*e*. A first transverse integral hinge extends across the back support plate 2*e* and the side plates 4*e* and 6*e* along the junction of the back support plate sections 42*a* and 42*b*. A second straight transverse integral hinge extends across the back support plate 2*e* and the side plates 4*e* and 6*e* along the junction of the back support plate sections 42*b* and 42*c*. This embodiment has the advantage of somewhat simplified construction, but the bending lines along the transverse hinges produce discontinuities in the front surface of the back support plate that may be undesirable in some instances and require padding or other treatment.

In the construction shown in FIGS. 11 and 12, the three hinge sections 44*a*, 44*b* and 44*c*, considered together, form an approximation of the curved hinge line 8 of FIG. 1, while the three hinge sections 46*a*, 46*b* and 46*c* together form an approximation of the curved hinge 12. Therefore, for the present purposes, the side plates 4*e* and 6*e* are considered to have "curved edges" and to be connected to the back support plate 2*e* along "curved hinge lines".

The back support mechanism described here is used in most instances by placing it in or attaching it to a conventional chair or seat. Other applications, however, may find the mechanism to be useful. Some examples: the mechanism may be used to control the contour of a table, bed or other surface for orthopedic applications; or the mechanism may be incorporated into an existing or new support structure, in which case the straps 16 and 17 will be replaced by an alternate locking arrangement.

I claim:

1. A spinal appliance for directly controlling the posture of a human lower back of a human spine of a nominal human subject by so contacting the lower back as to consistently force lower back vertebrae repeatedly into their appropriate lumbar curvature in response to sitting in a chair in which the appliance is positioned at the back of the chair in position to confront the lower back vertebrae of the nominal human subject, comprising:

a posture-controlling support sheet having a front and a back and defining a plane, said sheet formed of a moulded resilient plastic material having a thickness and rigidity sufficient to support the lower back, said sheet having a posture-correcting two-dimensional lower-back-contacting surface having a longitudinal length as long as the lower back of the nominal human subject is long and a transverse width at least as wide as the spine thereof is wide;

a strength and form imparting lever defining a major plane, said lever formed of a moulded resilient plastic material having a length no longer that the length of the posture-controlling support sheet and having a width;

a substantially arcuate articulation coupling said posture-controlling support sheet and said strength and form imparting lever along an arcuate joint defining a preselected slope, said joint being generally centrally located with respect to said back of said sheet;

said two-dimensional surface of said sheet is selectively formable into a posture-correcting shape in response to angular motion of said lever about said arcuate joint from an initial condition in which the planes of the lever and sheet are generally parallel to an operative condition in which the lever is generally transverse the posture-controlling sheet at a selected angular orientation thereto;

one of the dimensions of the two-dimensional surface of the posture-controlling sheet in the posture-correcting shape is curvilinearly extending with a preselected curvature, the other dimension of the two-dimensional surface of the posture-controlling sheet in the back supporting shape is generally linearly extending;

the lever having a thickness, width and rigidity sufficient to prevent buckling of the lever along its width in response to the contacting of the lower-back-contacting surface and the lower back of a human subject;

said preselected slope of the arcuate joint is selected such that said preselected curvature of the two-dimensional surface of the posture-controlling support sheet in the posture-correcting shape everywhere locally conforms to the lumbar curve of the vertebrae of the lower back of the nominal human subject; and adjustable means coupled to said lever for maintaining said lever fixed against angular motion in its operative condition at any selected angular orientation of said lever.

2. The invention of claim 1, wherein said arcuate articulation is formed of a moulded resilient plastic material and is integral with said sheet and said lever in such a way that said sheet, said lever and said arcuate joint are integrally formed.

3. The invention of claim 2, wherein said arcuate articulation is injection moulded.

4. The invention of claim 1, wherein said arcuate articulation is discrete from said sheet and said lever.

5. The invention of claim 4, wherein said arcuate articulation includes plural discrete hinge elements.

6. The invention of claim 1, wherein said arcuate joint is continuously arcuate.

7. The invention of claim 1, wherein said arcuate joint is arcuate by several linear segments that more or less approximate being arcuate.

8. The invention of claim 1, wherein said resilient plastic material is oriented polypropylene.

9. The invention of claim 1, further including means for providing roll-up of said sheet and said lever to a compact state.

10. A spinal appliance for directly controlling the posture of a human lower back of a human spine of a nominal human subject by so contacting the lower back as to consistently force lower back vertebrae repeatedly into their appropriate lumbar curvature in response to sitting in a chair in which the appliance is positioned at the back of the chair in position to confront the lower back vertebrae of the nominal human subject, comprising:

a posture-controlling support sheet having opposing lateral edges defining a plane, said sheet formed of a moulded resilient plastic material having a thickness and ridigity sufficient to support the lower back, said sheet having a posture-correcting two-dimensional lower-back-contacting surface having a longitudinal length as long as the lower back of the nominal human subject is long and a transverse width at least as wide as the spine thereof is wide;

a first strength and form imparting lever defining a major plane, said first lever formed of a moulded resilient plastic material having a length no longer than the length of the posture-controlling support sheet and having a width;

a first substantially arcuate articulation coupling said posture-controlling support sheet and said first strength and form imparting lever along a first arcuate joint defining a preselected slope and located along one of said lateral edges;

said two-dimensional surface of said sheet is selectively formable into a posture-correcting shape in response to angular motion of said first lever about said first arcuate joint from an initial condition in which the planes of the first lever and sheet are generally parallel to an operative condition in which the first lever is generally transverse the posture-controlling sheet at a selected angular orientation thereto;

a second strength and form imparting lever defining a major plane, said second lever formed of a moulded resilient plastic material having a length no longer than the length of the posture-controlling support sheet and having a width;

a second substantially arcuate articulation coupling said posture-controlling support sheet and said second strength and form imparting lever along a second arcuate joint defining a preselected slope and located along the other one of said lateral edges;

said two-dimensional surface of said sheet is selectively formable into the posture-correcting shape in response to angular motion of said second lever about said second arcuate joint from an initial condition in which the planes of the second lever and sheet are generally parallel to a condition in which the second lever is generally transverse the posture-controlling sheet at a selected angular orientation thereto;

one of the dimensions of the two-dimensional surface of the posture-controlling sheet in the posture-correcting shape is curvilinearly extending with a preselected curvature, the other dimension of the two-dimensional surface of the posture-controlling sheet in the posture-correcting shape is generally linearly extending;

said first and said second levers having a thickness, width and rigidity sufficient to prevent buckling of the respective first and second levers in response to the contacting of the lower-back-contacting surface and the lower back of a human subject;

said preselected slopes of the first and second arcuate joints are selected such that said preselected curvature of the two-dimensional surface of the posture-controlling support sheet in the posture-correcting shape everywhere locally conforms to the lumbar curve of the vertebrae of the lower back of the nominal human subject; and adjustable means coupled to said levers for maintaining said levers fixed against angular motions in their operative conditions at any selected angular orientations of said levers.

11. The invention of claim 10, wherein said arcuate articulations are formed of a moulded resilient plastic material and are integral with said sheet and said levers respectively in such a way that said sheet, said levers and said arcuate joints are integrally formed.

12. The invention of claim 11, wherein said arcuate articulations are injection moulded.

13. The invention of claim 10, wherein said arcuate articulations are discrete from said sheet and said levers.

14. The invention of claim 13, wherein said arcuate articulations include plural discrete hinge elements.

15. The invention of claim 10, wherein said arcuate joints are continuously arcuate.

16. The invention of claim 10, wherein said arcuate joints are arcuate by several linear segments that more or less approximate being arcuate.

17. The invention of claim 10, wherein said resilient plastic material is oriented polypropylene.

18. The invention of claim 10, further including means integrally formed with said sheet and said levers cooperative to provide roll-up of said sheet and said levers to a compact state.

19. A spinal appliance for directly controlling the posture of a human lower back of a human spine of a nominal human subject by so contacting the lower back as to consistently force lower back vertebrae repeatedly into their appropriate lumbar curvature in response to sitting in a chair in which the appliance is positioned at the back of the chair in position to confront the lower back vertebrae of the nominal human subject, comprising:

a posture-controlling support sheet defining a plane and having a front and a back, said sheet formed of a moulded resilient plastic material having a thickness and rigidity sufficient to support the lower back, said sheet having a posture-correcting two-dimensional lower-back-contacting surface having a longitudinal length as long as the lower back of the nominal human subject is long and a transverse width at least as wide as the spine thereof is wide;

a first strength and form imparting lever defining a major plane, said first lever formed of a moulded resilient plastic material having a length no longer than the length of the posture-controlling support sheet and having a width;

a first substantially arcuate articulation coupling said posture-controlling support sheet and said first strength and form imparting lever along a first arcuate joint defining a preselected slope and located along the back of said sheet;

said two-dimensional surface of said sheet is selectively formable into a posture-correcting shape in response to angular motion of said first lever about said first arcuate joint from an initial condition in which the planes of the first lever and sheet are generally parallel to a condition in which the first lever is generally transverse the posture-controlling sheet at a selected angular orientation thereto;

a second strength and form imparting lever defining a major plane, said second lever formed of a moulded resilient plastic material having a length no longer then the length of the posture-controlling support sheet and having a width;

a second substantially arcuate articulation coupling said posture-controlling support sheet and said second strength and form imparting lever along a second arcuate joint defining a preselected slope and located along the back of said sheet but spaced from said first lever;

said two-dimensional surface of said sheet is selectively formable into the posture-correcting shape in response to motion of said second lever about said second arcuate joint from an initial condition in which the planes of the second lever and sheet are generally parallel to an operative condition in which the plane of the second lever is generally transverse the posture-controlling sheet at a selected angular orientation thereto;

one of the dimensions of the two-dimensional surface of the posture-controlling sheet in the posture-correcting shape is curvilinearly extending with a preselected curvature, the other dimension of the two-dimensional surface of the posture-controlling sheet in the posture-correcting shape is generally linearly extending;

said first and said second levers each have a thickness, width and rigidity sufficient to prevent buckling of the respective first and second levers in response to the contacting of the lower-back-contacting surface and the lower back of a human subject;

said preselected slopes of the first and second arcuate joints are selected such that said preselected curvature of the two-dimensional surface of the posture-controlling support sheet in the posture-correcting shape everywhere locally conforms to the lumbar curve of the vertebrae of the lower back of the nominal human subject; and adjustable means coupled to said levers for maintaining said levers fixed against angular motions in their operative conditions at any selected angular orientations of said levers.

20. The invention of claim 19, wherein said arcuate articulations are formed of a moulded resilient plastic material and are integral with said sheet and said levers in such a way that said sheet, said levers and said arcuate joints are integrally formed.

21. The invention of claim 20, wherein said arcuate articulations are injection moulded.

22. The invention of claim 19, wherein said arcuate articulations are discrete from said sheet and said lever.

23. The invention of claim 22, wherein said arcuate articulations include plural discrete hinge elements.

24. The invention of claim 19, wherein said arcuate joints are continuously arcuate.

25. The invention of claim 19, wherein said arcuate joints are arcuate by several linear segments that more or less approximate being arcuate.

26. The invention of claim 19, wherein said resilient plastic material is oriented polypropylene.

27. The invention of claim 19, further including means integrally formed with said sheet and said levers cooperative to provide roll-up of said sheet and said levers to a compact state.

28. A spinal appliance for directly controlling the posture of a human lower back of a human spine of a nominal human subject by so contacting the lower back as to consistently force lower back vertebrae repeatedly into their appropriate lumbar curvature in response to sitting in a chair in which the appliance is positioned at the back of the chair in position to confront the lower back vertebrae of the nominal human subject, comprising;

a posture-controlling support sheet having opposing lateral edges defining a plane, said sheet formed of resilient material having a thickness and rigidity sufficient to support the lower back, said sheet having a posture-correcting two-dimensional lower-back-contacting surface having a longitudinal length as long as the lower back of the nominal human subject is long and a transverse width at least as wide as the spine thereof is wide;

a first strength and form imparting lever defining a major plane, said first lever formed of a resilient material having a length no longer than the length of the posture-controlling support sheet and having a width;

a first substantially arcuate articulation coupling said posture-controlling support sheet and said first strength and form imparting lever along a first arcuate joint defining a preselected slope and located along one of said lateral edges;

said two-dimensional surface of said sheet is selectively formable into a posture-correcting shape in response to angular motion of said first lever about said first arcuate joint from an initial condition in which the planes of the first lever and sheet are generally parallel to an operative condition in which the first lever is generally transverse the posture-controlling sheet at a selected angular orientation thereto;

a second strength and form imparting lever defining a major plane, said second lever formed of a resilient material having a length no longer than the length of the posture-controlling support sheet and having a width;

a second substantially arcuate articulation coupling said posture-controlling support sheet and said second strength and form imparting lever along a second arcuate joint defining a preselected slope and located along the other one of said lateral edges;

said two-dimensional surface of said sheet is selectively formable into the posture-correcting shape in response to angular motion of said second lever about said second arcuate joint from an initial condition in which the planes of the second lever and sheet are generally parallel to a condition in which the second lever is generally transverse the posture-controlling sheet at a selected angular orientation thereto;

one of the dimensions of the two-dimensional surface of the posture-controlling sheet in the posture-correcting shape is curvilinearly extending with a preselected curvature, the other dimension of the two-dimensional surface of the posture-controlling sheet in the posture-correcting shape is generally linearly extending;

said first and said second levers having a thickness, width and rigidity sufficient to prevent buckling of the respective first and second levers in response to the contacting of the lower-back-contacting surface and the lower back of a human subject;

said preselected slopes of the first and second arcuate joints are selected such that said preselected curvature of the two-dimensional surface of the posture-controlling support sheet in the posture-correcting shape everywhere locally conforms to the lumbar curve of the vertebrae of the lower back of the nominal human subject; and adjustable means coupled to said levers for maintaining said levers fixed against angular motions in their operative conditions at any selected angular orientations of said levers.

29. The invention of claim 28, wherein said arcuate articulations are formed of a resilient material and are integral with said sheet and said levers in such a way that said sheet, said levers and said arcuate joints are integrally formed.

30. The invention of claim 28, wherein said arcuate articulations are discrete from said sheet and said levers.

31. The invention of claim 30, wherein said articulations include plural discrete hinge elements.

32. The invention of claim 28, wherein said arcuate joints are continuously arcuate.

33. The invention of claim 28, wherein said arcuate joints are arcuate by several linear segments that more or less approximate being arcuate.

34. A spinal appliance for directly controlling the posture of a human lower back of a human spine of a nominal human subject by so contacting the lower back as to consistently force lower back vertebrae repeatedly into their appropriate lumbar curvature in response to sitting in a chair in which the appliance is positioned at the back of the chair in position to confront the lower back vertebrae of the nominal human subject, comprising:

a posture-controlling support sheet having a front and a back and defining a plane, said sheet formed of a resilient material having a thickness and rigidity sufficient to support the lower back, said sheet having a posture-correcting two-dimensional lower-back-contacting surface having a longitudinal length as long as the lower back of the nominal human subject is long and a transverse width at least as wide as the spine thereof is wide;

a strength and form imparting lever defining a major plane, said lever formed of a resilient material having a length no longer than the length of the posture-controlling support sheet and having a width;

a substantially arcuate articulation coupling said posture-controlling support sheet and said strength and form imparting lever along an arcuate joint defining a preselected slope, said joint being generally centrally located with respect to said back of said sheet;

said two-dimensional surface of said sheet is selectively formable into a posture-correcting shape in response to angular motion of said lever about said arcuate joint from an initial condition in which the planes of the lever and sheet are generally parallel to an operative condition in which the lever is generally transverse the posture-controlling sheet at a selected angular orientation thereto;

one of the dimensions of the two-dimensional surface of the posture-controlling sheet in the posture-correcting shape is curvilinearly extending with a preselected curvature, the other dimension of the two-dimensional surface of the posture-controlling sheet in the back supporting shape is generally linearly extending;

the lever having a thickness, width and rigidity sufficient to prevent buckling of the lever along its width in response to the contacting of the lower-back-contacting surface and the lower back of a human subject;

said preselected slope of the arcuate joint is selected such that said preselected curvature of the two-dimensional surface of the posture-controlling support sheet in the posture-correcting shape everywhere locally conforms to the lumbar curve of the vertebrae of the lower back of the nominal human subject; and adjustable means coupled to said lever for maintaining said lever fixed against angular motion in its operative condition at any selected angular orientation of said lever.

35. The invention of claim 34, wherein said arcuate articulation is formed of a resilient material and is integral with said sheet and said lever in such a way that said sheet, said lever and said arcuate joint are integrally formed.

36. The invention of claim 34, wherein said arcuate articulation is discrete from said sheet and said lever.

37. The invention of claim 36, wherein said arcuate articulation includes plural discrete hinge elements.

38. The invention of claim 34, wherein said arcuate joint is continuously arcuate.

39. The invention of claim 34, wherein said arcuate joint is arcuate by several linear segments that more or less approximate being arcuate.

40. A spinal appliance for directly controlling the posture of a human lower back of a human spine of a nominal human subject by so contacting the lower back as to consistently force lower back vertebrae repeatedly into their appropriate lumbar curvature in response to sitting in a chair in which the appliance is positioned at the back of the chair in position to confront the lower back vertebrae of the nominal human subject, comprising:

a posture-controlling support sheet defining a plane and having a front and a back, said sheet formed of a resilient material having a thickness and rigidity sufficient to support the lower back, said sheet having a posture-correcting two-dimensional lower-back-contacting surface having a longitudinal length as long as the lower back of the nominal human subject is long and a transverse width at least as wide as the spine thereof is wide;

a first strength and form imparting lever defining a major plane, said first lever formed of a resilient material having a length no longer than the length of the posture-controlling support sheet and having a width;

a first substantially arcuate articulation coupling said posture-controlling support sheet and said first strength and form imparting lever along a first arcuate joint defining a preselected slope and located along the back of said sheet;

said two-dimensional surface of said sheet is selectively formable into a posture-correcting shape in response to angular motion of said first lever about said first arcuate joint from an initial condition in which the planes of the first lever and sheet are generally parallel to a condition in which the first lever is generally transverse the posture-controlling sheet at a selected angular orientation thereto;

a second strength and form imparting lever defining a major plane, said second lever formed of a resilient material having a length no longer then the length of the posture-controlling support sheet and having a width;

a second substantially arcuate articulation coupling said posture-controlling support sheet and said second strength and form imparting lever along a second arcuate joint defining a preselected slope and located along the back of said sheet but spaced from said first lever;

said two-dimensional surface of said sheet is selectively formable into the posture-correcting shape in response to motion of said second lever about said second arcuate joint from an initial condition in which the planes of the second lever and sheet are generally parallel to an operative condition in which the plane of the second lever is generally transverse the posture-controlling sheet at a selected angular orientation thereto;

one of the dimensions of the two-dimensional surface of the posture-controlling sheet in the posture-correcting shape is curvilinearly extending with a preselected curvature, the other dimension of the two-dimensional surface of the posture-controlling sheet in the posture-correcting shape is generally linearly extending;

said first and said second levers each have a thickness, width and rigidity sufficient to prevent buckling of the respective first and second levers in response to the contacting of the lower-back-contacting surface and the lower back of a human subject;

said preselected slopes of the first and second arcuate joints are selected such that said preselected curvature of the two-dimensional surface of the posture-controlling support sheet in the posture-correcting shape everywhere locally conforms to the lumbar curve of the vertebrae of the lower back of said the nominal human subject; and adjustable means coupled to said levers for maintaining said levers fixed against angular motions in their operative conditions at any selected angular orientations of said levers.

41. THe invention of claim 40, wherein said arcuate articulations, are formed of a resilient material and are integral with said sheet and said levers in such a way that said sheet, said levers and said arcuate joints are integrally formed.

42. The invention of claim 40, wherein said arcuate articulations are discrete from said sheet and said levers.

43. The invention of claim 42, wherein said arcuate articulations include plural discrete hinge elements.

44. The invention of claim 40, wherein said arcuate joints are continuously arcuate.

45. The invention of claim 40, wherein said arcuate joints are arcuate by several linear segments that more or less approximate being arcuate.

* * * * *